United States Patent [19]

Kojima et al.

[11] Patent Number: 4,565,238

[45] Date of Patent: Jan. 21, 1986

[54] METHOD OF STIRRING MOLTEN STEEL IN A CONTINUOUSLY CASTING MOLD AND AN APPARATUS THEREFOR

[75] Inventors: Shinji Kojima; Hisakazu Mizota, both of Okayama; Masanori Kodama, Kurashiki; Yasuharu Miyazaki, Soja, all of Japan

[73] Assignees: Kawasaki Steel Corporation, Kobe, Japan; ASEA AB, Västerås, Sweden

[21] Appl. No.: 522,170

[22] PCT Filed: Dec. 8, 1982

[86] PCT No.: PCT/JP82/00461

§ 371 Date: Aug. 4, 1983

§ 102(e) Date: Aug. 4, 1983

[87] PCT Pub. No.: WO83/02079

PCT Pub. Date: Jun. 23, 1983

[30] Foreign Application Priority Data

Dec. 11, 1981 [JP] Japan ..... 56-198359

[51] Int. Cl.[4] ..... B22D 27/02

[52] U.S. Cl. ..... 164/468; 164/504

[58] Field of Search ..... 164/468, 504, 147.1, 164/499

[56] References Cited

U.S. PATENT DOCUMENTS

| | | | |
|---|---|---|---|
| 4,030,534 | 6/1977 | Ito et al. | 164/468 |
| 4,298,050 | 11/1981 | Ohashi et al. | 164/468 |

FOREIGN PATENT DOCUMENTS

| | | | |
|---|---|---|---|
| 2324397 | 4/1977 | France . | |
| 2383732 | 10/1978 | France . | |
| 2485411 | 12/1981 | France . | |
| 52-34007 | 9/1977 | Japan | 164/468 |
| 55-40004 | 3/1980 | Japan | 164/468 |

*Primary Examiner*—Nicholas P. Godici
*Assistant Examiner*—Richard K. Seidel
*Attorney, Agent, or Firm*—Balogh, Osann, Kramer, Dvorak, Genova & Traub

[57] ABSTRACT

The present invention relates to a technique or method for stirring molten steel, wherein molten steel charged in a mold for continuous casting is circulated in a smooth flow in order to promote the degassing of the steel as well as to prevent the formation of surface defects on the cast steel. In order to carry out such desirable stirring, the present invention provides for a plurality of electromagnetic stirrers (capable of applying different magnetic field intensities) to be arranged along both long side walls of the casting mold so that the circulating flow of the molten steel can be accelerated or decelerated (depending upon its position) to form a smooth flow.

2 Claims, 12 Drawing Figures

METHOD OF STIRRING MOLTEN STEEL IN A CONTINUOUSLY CASTING MOLD AND AN APPARATUS THEREFOR

TECHNICAL FIELD

The present invention relates to a method of stirring molten steel in a continuous casting mold and an apparatus therefor. More particularly, the present invention provides a novel technique in production of steel by continuous casting. The technique includes molten steel poured into a continuous casting mold from a tundish and moved along the inner wall of the mold at different flow rates depending upon its position in the mold while being stirred moderately into a smooth flow. The present invention, by providing for moving the moderately stirred molten steel in a smooth flow along the inner wall of the mold, promotes the degassing of the resulting cast steel.

BACKGROUND ART

Continuous casting of non-deoxidized steel and weakly deoxidized steel, such as rimmed steel and semi-rimmed steel, has a drawback reflected in the operation and quality of the steel. This drawback, which involves the generation of bubbles during the casting of the steel, or the fact that bubbles remain in the cast steel to cause trouble, has prevented the continuous casting of non-deoxidized steel and weakly deoxidized steel from being practically carried out. However, various investigations have recently been made with respect to the technique for removing gas in molten steel by circularly moving (stirring) the molten steel in a continuous casting mold by means of an electromagnetic stirrer (a large number of the investigations have been actually reported). Similar to the above described method and apparatus for stirring electromagnetically molten steel in a casting mold, there are other various methods and apparatuses. However, when the effect for improving the operability and the quality of cast steel was taken into consideration, a circular flow which rotates on a horizontal plane as illustrated in FIG. 1 was most effective. In the stirring technique illustrated in FIG. 1, electromagnetic stirrers 3 and 3' are oppositely arranged on the walls of both long sides 2*a* and 2*a'* of a casting mold 2, and electromagnetic forces 4 and 4' which are in reverse directions with each other act on the molten steel flow, whereby the molten steel 1 is moved in a direction indicated by the arrows 5 and 5' and is stirred. When such flow is caused in the molten steel, bubbles caught in the vicinity of the solidifying interface are again washed and moved and are promoted to be floated up to the molten steel surface so that the bubbles contained in the molten steel are effectively removed. The flow rate of the molten steel necessary for removing bubbles is about 0.2–1.0 m/sec, and is generally preferred to be at least 0.5 m/sec.

FIGS. 2 and 3 illustrate the distribution of flow rate of molten steel in the flow illustrated in FIG. 1. FIGS. 2 and 3 illustrate the distribution of flow rate at the initial stage of acceleration when the average flow rate of the molten steel is 0.5 m/sec. Furthermore, the flow rate distribution is not constant even in the thickness direction (y direction in FIG. 1) of the cast steel, but has a distribution illustrated in FIG. 3. Accordingly, when the flow rate distribution in the width direction (x direction in FIG. 1) of cast steel is shown by using positions (a and b in FIG. 3), at which the flow rate becomes maximum ($v_{max}$) and the average flow rate becomes minimum ($v_{mean}$) (as representative points), the flow rate distribution shown in FIG. 2 is obtained.

It can be seen from FIG. 2 that, in such prior techniques, the flow rate is short in the first half (E-L) of acceleration, and is excessively high in the second half (L-F) thereof. Particularly, the flow rate becomes a maximum flow rate of 1.4 m/sec and is about 3 times the amount of the average flow rate at the position at which the molten steel collides with the short side wall (2*b*) in the finishing stage (F-B) of acceleration. When the rate of the circulating flow of molten steel in a casting mold along the wall in the horizontal direction is not uniform, the following troubles occur. That is, at a short flow rate position, bubbles can not be fully removed, and surface defects, such as pin holes and the like, are caused; and reversely, at an excessively high flow rate position, troubles, such as slag patches, formation of oscillation marks and the like, are caused due to the lap of powder and the like. Particularly, at the collision portion of molten steel flow with the short side wall 2*b*, lap of powder is apt to be caused due to the jumping of molten steel.

In order to resolve the above described various problems, there has been proposed a method, wherein an electromagnetic stirrer 3 is rotated at a constant stirring strength in order to minimize the adverse effects due to the non-uniform flow rate of molten steel in the width direction of the cast steel.

However, although maintaining the stirring strength at a constant value can control the stirring rate, unevenness of flow rate due to the difference of positions can not be overcome. Therefore, the above described problems could not have been fundamentally solved by the aforementioned method.

In order to prevent the jumping of molten steel surface at the collision portion of the molten steel flow with the short side wall, there has been proposed a technique, wherein the short side walls 2*b* and 2*b'* are made into a semi-circular shape, or are cut down at the corner portions as illustrated in FIGS. 5 and 6, whereby the circulating flow of molten steel is made smooth to prevent the jumping of the molten steel surface.

However, in many molds for casting slab, the short side wall 2*b* is formed of a separated part as illustrated in FIG. 6 so that the width of cast steel can be changed. Accordingly, if the short side wall 2*b* is made into a semi-circular shape, both end portions of the short side wall (the portion shown by A in FIG. 6) have a very small thickness and are easily melted and broken, or deformed. Moreover, it is practically difficult to produce a short side wall having such shape. In order to obviate this problem, a casting mold having a shape illustrated in FIG. 5 is generally and practically used. In this case, the jumping of the molten steel surface at the collision portion of the molten steel flow with the short side wall can not be fully prevented, and the use of a casting mold having such structure alone can not fundamentally solve the problem.

The present invention intends to obviate the above described drawbacks of the conventional technique for stirring molten steel in a casting mold, and provides an electromagnetic stirring method for molten steel and an apparatus used for the method. According to the present invention the flow of molten steel in the width direction of cast steel (long side wall side of a mold) is made as uniform as possible to prevent the above described drawbacks of the cast steel (due to the non-uniform flow rate in the conventional method), and at the same time the flow rate of molten steel at the collision portion with the short side wall is decreased to prevent the formation of surface defects of cast steel due to jumping of the molten steel surface.

SUMMARY OF THE INVENTION

The method of stirring molten steel in a continuous casting mold according to the present invention is characterized in that a plural number of electromagnetic stirrers are arranged on the wall of a continuous casting mold and used for stirring the molten steel. This method includes the moving of the molten steel in the form of a circulating flow in a horizontal direction along the wall of the mold such that the magnetic field intensity of each electromagnetic stirrer is varied depending upon the position of the molten steel in the mold, to stir the molten steel while accelerating or decelerating the circulating flow of the molten steel in the mold along the flow direction of the molten steel. In carrying out the method, there is used a stirring apparatus for molten steel having a plural number of electromagnetic stirrers, which can vary magnetic field intensity and are arranged along the horizontal direction of both long side walls of a continuous casting mold.

The inventors have found out, after investigation, that the flow rate pattern illustrated in FIG. 7 is an ideal flow rate pattern of molten steel flow in a casting mold. That is, it is preferable to use an electromagnetic stirrer which can accelerate the molten steel as rapidly as possible up to a predetermined flow rate $v_n$ within the initial rising-up region or upstream side (region A-M), can maintain constantly the flow rate $v_n$ thereafter, and can decelerate rapidly the molten steel to the critical flow rate $v_b$, within the falling-down or downstream region (region N-B) which does not cause lap of powder, at the time of collision of the molten steel with the short side wall shown by point B. That is, it is preferable to stir molten steel such that the molten steel flow moves mainly according to the above described pattern within the range of M-N of the long side wall of the casting mold.

On the contrary, in the conventional stirring system illustrated in FIG. 1, molten steel flows or moves according to the flow pattern as illustrated in FIG. 2, and the above described favorable flow pattern can not be obtained.

In the present invention, instead of using a single electromagnetic stirrer (as used in the conventional method), it provides for the use of a large number (plurality) of electromagnetic stirrers which can vary the magnetic field intensity in the mold. In each of these electromagnetic stirrers (hereinafter, referred to as stirrers), the intensity and direction of magnetic field can be varried by changing the number of windings of coil or the electric current, and these electromagnetic stirrers have different magnetic field intensities. That is, the present invention relates to a technique for obtaining an ideal pattern as illustrated in FIG. 7 by using a plurality of stirrers having different magnetic field intensities.

BEST MODE OF CARRYING OUT THE INVENTION

Figure 8:
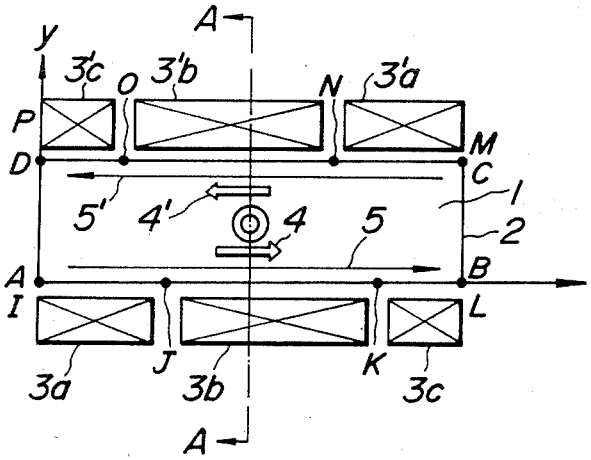
FIG. 8 is a plan view illustrating one embodiment of the method of the present invention.

FIG. 8 illustrates one advantageous embodiment of the arrangements of stirrers to be used in the present invention. In this embodiment, stirrers *3a, 3a', 3b, 3b', 3c* and *3c'* are arranged such that three kinds of stirrers are arranged on each side. In order to obtain an ideal pattern, these three kinds of stirrers *3a . . . 3c'* are arranged in the following manner. As the stirrers *3a* and *3a'* are to be arranged in a rising-up or upstream region (I-J or M-N), wherein a rapid acceleration of molten steel is required, use is made of ones having a coil which have a high magnetic field intensity and a vigorous stirring action, and being capable of accelerating rapidly the molten steel up to a necessary flow rate $v_n$. As the stirrers *3b* and *3b'* are to be arranged in an intermediate position, wherein neither acceleration nor deceleration of molten steel are required, ones having a mild stirring action are used in order to increase the flow rate in an amount required to restore the decreased flow rate due to fluid resistance, and to maintain the $v_n$. Further, as the stirrers *3c* and *3c'* are to be arranged in a falling-down or downstream region (K-L or O-P), wherein deceleration of molten steel is required, use is made of ones having a reversely turned coil and capable of negatively accelerating the molten steel so as to brake it and to decrease rapidly its flow rate to the critical flow rate $v_b$, which is free from the lap of powder.

Figure 1:
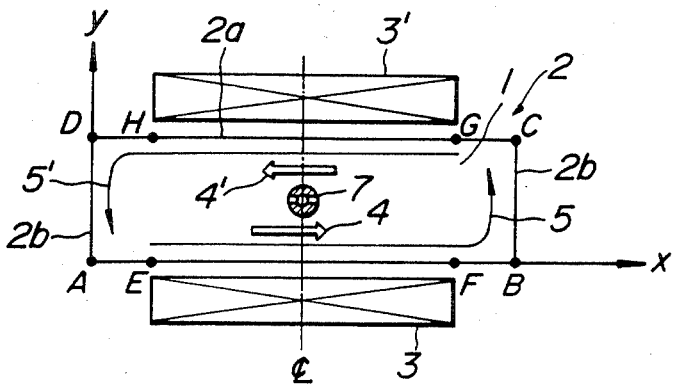
FIG 1 PRIOR ART
FIG. 1 is a plan view of a casting mold using an electromagnetic stirrer according to a conventional stirring system.
Figure 2:
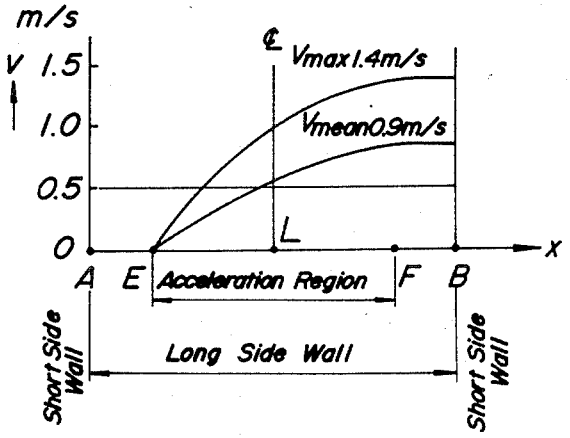
FIG 2 PRIOR ART
FIGS. 2 and 3 are characteristic property diagrams of the flow rate pattern in x-direction and y-direction of the molten steel in FIG. 1, respectively.
Figure 3:
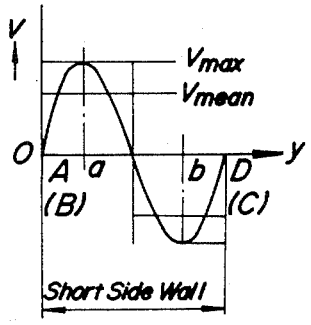
FIG 3 PRIOR ART
Figure 7:
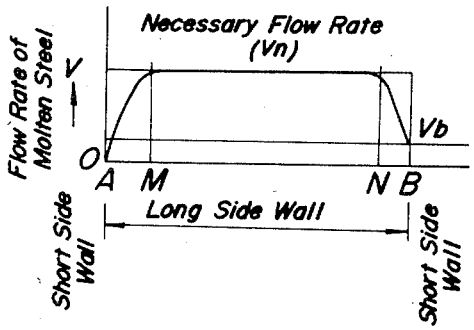
FIG. 7 is a characteristic property diagram of an ideal flow rate pattern.
Figure 9:
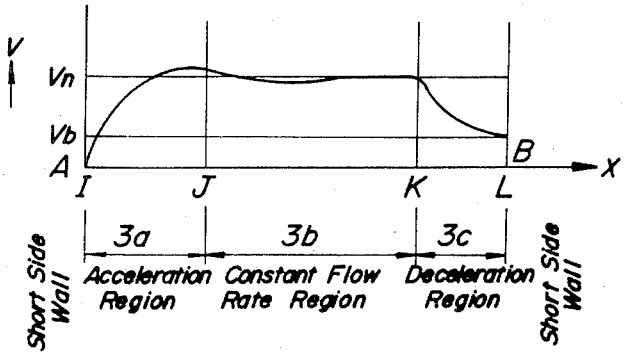
FIG. 9 is a characteristic property diagram of the flow rate pattern in the method illustrated in FIG. 8.

As described above, the object of the present invention can be attained by arranging stirrers *3a, 3a', 3b, 3b', 3c* and *3c'* along the long side walls *2a* and *2a'* of a casting mold such that three kinds of stirrers having different magnetic field intensities (which are used for acceleration, for maintaining the constant flow rate and for deceleration) are properly arranged so as to cause a smooth circulating flow in the casting mold. FIG. 9 illustrates the flow rate pattern obtained by the above described arrangement of stirrers. This pattern clearly resembles the ideal pattern (illustrated in FIG. 7) more than the conventional pattern illustrated in FIG. 2.

In the above described embodiment, three kinds of stirrers *3a . . . 3c'* are arranged in each of long side walls 2 and 2' of a casting mold. However, when the long side wall of a casting mold (width direction of cast steel) is further divided into a larger number of regions and a larger number of stirrers are arranged and the stirring strength of each stirrer is controlled by regulating the magnetic field intensity, a flow rate pattern which resembles the ideal pattern more than this embodiment can be obtained. However, it is a fundamental technical idea that the flow rate pattern is divided into three regions of acceleration, constant flow rate and deceleration in view of function. This fundamental technical idea is effectively applicable to the case where the width of casting steel is changed. As a modification of this embodiment, use may be made of an arrangement, wherein the above described two stirrers are used in combination, and which is simpler in structure than the arrangement of this embodiment.

Figure 10:
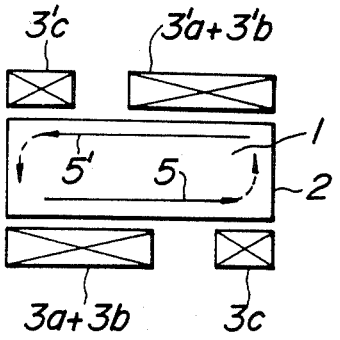
FIGS. 10, 11 and 12 are plan views of the flow of molten steel in other embodiments of the present invention.
Figure 11:
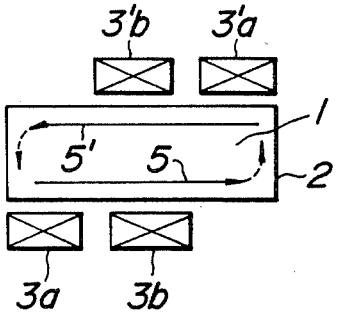
Figure 12:
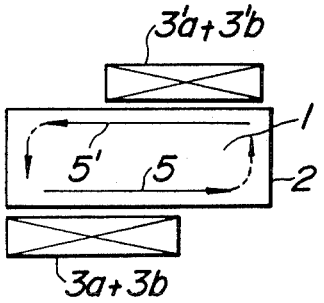

FIG. 10 is a two-block system arrangement, wherein stirrers 3*a* and 3*b* having the same magnetic field intensity are used in combination for accelerating the molten steel, and the remaining one stirrer 3*c* is used for decelerating it. FIG. 11 is an arrangement, wherein the deceleration of molten steel is carried out by the natural fluid resistance, and the stirrer 3*c* for the deceleration used in the above described embodiment is omitted. Further, FIG. 12 illustrates an arrangement, wherein two stirrers 3*a* and 3*b* are used for acceleration and are arranged in the forepart and acceleration region of the casting mold, and the deceleration stirrer 3*c* in the above described embodiment is omitted, whereby the two stirrers are assembled into one block. The above described embodiments are inferior in the flow rate pattern to the embodiment illustrated in FIG. 8, wherein three stirrers are arranged in each side, but are effective as modified embodiments of the present invention in the case where slab size is small and a large number of stirrers 1 can not be arranged.

Figure 4:
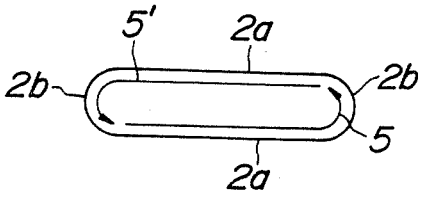
FIG 4 PRIOR ART
FIGS. 4 and 5 are plan views illustrating the shapes of the short side walls of conventional casting molds.
Figure 5:
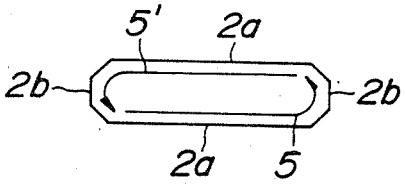
FIG 5 PRIOR ART
Figure 6:
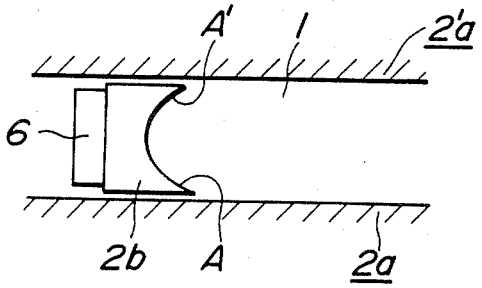
FIG 6 PRIOR ART
FIG. 6 is a partial and detailed plan view of FIG. 4.

When the above described method of the present invention is combined with the improvement of the shapes of the short side illustrated in FIGS. 4 and 5, the molten steel flow can be moved more effectively.

The control of magnetic field intensity (stirring strength) can be carried out in the following manner. That is, the electric current and polarity of the individual stirrers 3*a* . . . 3*c*′ are changed and the exciting strength of these stirrers are set to various combinations, such as "strong, weak, zero and reverse" to control the flow of molten steel. Alternatively, separate power sources are used in individual stirrers and the frequency is varied to control the flow of molten steel.

The present invention having the above described construction has the following merits.

(1) The electromagnetic stirring force of each stirrer arranged along the width direction of the cast steel can be independently controlled. Therefore, the flow rate of molten steel can be controlled to achieve an optimum flow rate necessary for floating up of gas over substantially the entire surface of the solidifying interface of the molten steel to be cast, and a cast steel having improved quality can be obtained.

(2) Molten steel is decelerated near the collision portion of the molten steel flow with the short side wall of a casting mold by means of a decelerating stirrer. Therefore there is no risk of lap of powder due to jumping of the molten steel surface at the collision portion with the short side wall of the casting mold, and defects of quality, such as slag patches and formation of oscillation mark, can be prevented.

(3) Independently operable stirrers are used, and moreover the stirrers to be used can be freely separated depending upon the use condition. Therefore, there is a high degree of freedom in the control of flow rate.

(4) As to the apparatus, when a conventional apparatus is separated into several blocks merely in the electric installation, the apparatus can be applied to the present invention. Therefore, the installation cost is inexpensive.

We claim:

1. In a method of stirring molten steel in a continuously casting mold having a pair of short side walls and a pair of long side walls, which method includes stirring the molten steel in the mold by moving it in the form of a circulating flow in a horizontal direction along the walls of the mold, by means of an electromagnetic stirrer arranged on the walls of the mold, the improvement which comprises using a plurality of electromagnetic stirrers varying the magnetic field intensity of the electromagnetic stirrers depending upon the position of the molten steel in the mold, so as to accelerate or decelerate or maintain at a constant flow rate the circulating flow of molten steel in the mold along the flow direction, and adjusting the magnetic field intensity of the electromagnetic stirrers such that the circulating flow of the molten steel in the mold is accelerated in an upstream region of the mold along the flow direction near one of said pair of short side walls of the mold, and is decelerated in a downstream region of the mold along the flow direction near the other of said pair of short side walls of the mold, and is kept at a constant flow rate in the intermediate region of the mold along the flow direction between the upstream region and the downstream region thereof, thereby forming a smooth flow of the circulating molten steel flow in the mold.

2. An apparatus for stirring molten steel in a circulating flow in a continuously casting mold having a pair of short side walls and a pair of long side walls, said apparatus comprising a plurality of electromagnetic stirrers which can vary their magnetic field intensity and which are arranged in a horizontal direction along both of said pairs of long side walls of the mold, a first stirrer of said plurality of electromagnetic stirrers being arranged in an upstream region of the mold along the flow direction and near one of said pair of short side walls of the mold, constituting means to accelerate the molten steel flow in the upstream region of the mold, a second stirrer of said plurality of electromagnetic stirrers being arranged in a downstream region of the mold along the flow direction and near the other of said pair of short side walls of the mold constituting means to decelerate the molten steel flow in the downstream region of the mold, a third stirrer of said plurality of electromagnetic stirrers being arranged in an intermediate region of the mold in the flow direction and between the upstream region and the downstream region of the mold constituting means to keep the accelerated flow of molten steel at a constant flow rate in the intermediate region of the mold, whereby said apparatus forms a smooth circulating flow of molten steel in the mold so as to promote the degassing of the steel and prevent the formation of surface defects on the surface of the cast steel.

* * * * *